US007780283B2

(12) United States Patent
Jones

(10) Patent No.: US 7,780,283 B2
(45) Date of Patent: Aug. 24, 2010

(54) INDEPENDENT KEYING AND GUIDANCE FOR SOLID INK STICKS

(75) Inventor: Brent Rodney Jones, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 796 days.

(21) Appl. No.: 11/593,973

(22) Filed: Nov. 7, 2006

(65) Prior Publication Data

US 2008/0122907 A1 May 29, 2008

(51) Int. Cl.
*B41J 2/175* (2006.01)

(52) U.S. Cl. ..... 347/88; 347/99; 347/103

(58) Field of Classification Search ..... 347/88.99, 347/103
See application file for complete search history.

(56) References Cited

U.S. PATENT DOCUMENTS

| | | | | |
|---|---|---|---|---|
| 5,223,860 | A | 6/1993 | Loofbourow et al. | |
| 5,442,387 | A * | 8/1995 | Loofbourow et al. | 347/88 |
| 5,861,903 | A * | 1/1999 | Crawford et al. | 347/99 |
| 5,975,690 | A | 11/1999 | Grellmann et al. | |
| 6,056,394 | A * | 5/2000 | Rousseau et al. | 347/88 |
| 6,543,867 | B1 | 4/2003 | Jones | |
| 6,672,716 | B2 * | 1/2004 | Jones | 347/99 |
| 6,755,517 | B2 | 6/2004 | Jones et al. | |
| 6,761,443 | B2 | 7/2004 | Jones | |
| 6,840,613 | B2 | 1/2005 | Jones | |
| 2003/0202065 | A1 | 10/2003 | Jones | |
| 2003/0202067 | A1 | 10/2003 | Jones et al. | |
| 2003/0202071 | A1 | 10/2003 | Jones et al. | |
| 2003/0222952 | A1 | 12/2003 | Jones | |

FOREIGN PATENT DOCUMENTS

| | | | |
|---|---|---|---|
| EP | 0519700 | A2 | 12/1992 |
| EP | 1359014 | A1 | 11/2003 |
| EP | 1359020 | A1 | 11/2003 |
| EP | 1366913 | A2 | 12/2003 |
| EP | 1552941 | A2 | 7/2005 |

OTHER PUBLICATIONS

Non-Final Office Action for U.S. Appl. No. 11/593,974 Mailed Jun. 9, 2009, United States Patent and Trademark Office (9 pages).
Amendment in Response to Non-Final Office Action for U.S. Appl. No. 11/593,974, submitted Sep. 8, 2009 (9 pages).

(Continued)

*Primary Examiner*—Manish S Shah
(74) *Attorney, Agent, or Firm*—Maginot, Moore & Beck LLP

(57) ABSTRACT

An ink loader for a phase change ink imaging device includes at least one guide member for maintaining alignment and orientation of ink sticks as the ink sticks feed to a melt area of an ink loader. The ink loader also includes a keyed opening through which ink sticks are inserted into the ink loader. The keyed opening is positioned with respect to the at least one guide member such that keying elements of ink sticks are spatially separated from the at least one guide member during and after insertion.

15 Claims, 15 Drawing Sheets

OTHER PUBLICATIONS

Final Office Action for U.S. Appl. No. 11/593,974 Mailed Mar. 23, 2010, United States Patent and Trademark Office (7 pages).
Non-Final Office Action for U.S. Appl. No. 11/593,972 Mailed May 20, 2009, United States Patent and Trademark Office (13 pages).
Amendment in Response to Non-Final Office Action for U.S. Appl. No. 11/593,972, submitted Aug. 12, 2009 (14 pages).
Non-Final Office Action for U.S. Appl. No. 11/593,971 Mailed Feb. 19, 2009, United States Patent and Trademark Office (12 pages).
International Search Report in corresponding European Application No. 07120121.4 mailed Feb. 22, 2008 (5 pages).
International Search Report in corresponding European Application No. 07120122.2 mailed Mar. 7, 2008 (5 pages).
Amendment accompanying a Request for Continued Examination for U.S. Appl. No. 11/593,974, submitted Apr. 22, 2010 (6 pages).
Amendment in Response to Non-Final Office Action for U.S. Appl. No. 11/593,971, submitted Apr. 22, 2010 (14 pages).

* cited by examiner

INDEPENDENT KEYING AND GUIDANCE FOR SOLID INK STICKS

CROSS-REFERENCE TO RELATED APPLICATIONS

Reference is made to commonly-assigned copending U.S. patent application Ser. No. 11,593,974, filed concurrently herewith, entitled "COMMON SIDE INSERTION KEYING FOR PHASE CHANGE INK STICKS," by Brent R. Jones et al., and commonly-assigned copending U.S. patent application Ser. No. 11/593,971 filed concurrently herewith, entitled "ONE-WAY COMPATIBILITY KEYING FOR SOLID INK STICKS", by Brent R. Jones et al., the disclosures of which are all incorporated herein by reference.

TECHNICAL FIELD

This disclosure relates generally to ink printers, the ink sticks used in such ink printers, and the devices and methods used to provide ink to such printers.

BACKGROUND

Solid ink or phase change ink printers conventionally receive ink in a solid form, as pellets or ink sticks. The solid ink pellets or ink sticks are placed in a feed chute and a feed mechanism delivers the solid ink to a heater assembly. Solid ink sticks are either gravity fed or urged by a spring through the feed chute toward a melt plate in the heater assembly. The melt plate melts the solid ink impinging on the plate into a liquid that is delivered to a print head for jetting onto a recording medium. Ink sticks for phase change ink printers have historically included bottom and side keying surfaces by which corresponding chutes and feed mechanisms (i.e., "ink loaders") of the printers guide or coax the ink sticks into optimal feed/melt positions. In horizontal or near horizontal ink loaders, gravity influences the ink stick positions as the ink sticks lean against chute walls or special side-rails. Special guides have even been incorporated into the bottoms of some ink sticks to facilitate their movement over corresponding bottom-rails of some horizontal feed ink loaders. Such guides, coupled with gravity, have typically worked reasonably well to properly position and orient the ink sticks for feeding to the heater plates. In such situations, the sides of the keying features have typically included the ink surfaces contacting the guides. Such guide and key integration has undesirably limited the keying features in that insertion exclusivity has not been the only function that the keying features have been relied upon to provide. In many cases, size, placement, and configuration of keying features has been as much a function of guidance requirements as keying considerations. Keying for insertion is typically intended to allow differentiation between colors and different product models, which can include marketing programs such as contractual or retail pricing of the ink, thus aside from guiding and support functions, the keying offers opportunity to exclude inappropriate colors or models of ink from being inserted in a given ink loader.

Meanwhile, conventional keying and guide features have been even less effective in vertical ink loaders as the ink sticks have been somewhat position/orientation influenced but in most cases have not been sufficiently constrained to properly feed to the heat plates. Some vertical ink loader guidance systems have even allowed their ink sticks to misalign to extents that they have rotated and jammed. Consequently, most phase change ink printers accommodating multiple ink sticks of each of various colors and incorporating heat plates have used horizontal rather than vertical ink loader systems.

Keying features for use in many horizontal ink loader systems have been focused on a two vector interface with the ink loader: one surface for insertion and another for feed, with the former surface typically transverse to the latter. In addition to relying on gravity, such sticks are typically made more complex in shape due to color and product series (model or model range) key features running in one direction and guidance elements or surfaces running in another. The large amount of stick geography devoted to color keying in historical ink stick designs has undesirably limited the flexibility and extensibility in product series key features. As with the ink loaders, making design changes to the complex shapes of such ink sticks can introduce undesirable risks of ink stick failure from stress fracturing and variations in cooling deformation, can undesirably increase tooling cost/complexity, and/or can undesirably increase product development times.

Thus, guidance in the afore-noted cases has relied primarily on combinations of ink stick surfaces including keying surfaces not designed or intended solely for guidance. Another shortcoming of conventional loaders is that insertion keying, including model or series keying, changes from product to product to ensure marketing, operational parameter, or formulation differentiation. Parts internal to the loader, such as push blocks, change in addition to the external key plates. As a result of the historical lack of uniformity in keying schemes and the integration of guidance and keying systems, each new phase change ink printer model has typically needed a new loader configuration, which has undesirably increased ink delivery costs and product development times.

Orienting an ink loader vertically could potentially improve usability and lower cost. A vertical loader could provide the benefit of using gravity as the primary force to move or feed the ink stick. While guides in horizontal loaders typically emphasize load bearing support, such load bearing would not be required by a vertical loader. However, as noted above, conventional ink shapes are not compatible with vertical loading. Conventional ink shapes are also not compatible with an insertion direction that is in-line with or parallel to the feed direction. Ink sticks used in loaders with independent insertion and feed directions, irrespective of loader orientation or ink feed to gravity, suffer from a lack of simplified extensibility in creating independence between color, model, support, guidance and feed keying.

Thus, there is a need for phase change ink printer ink sticks having independent guidance and keying features such that the flexibility and extensibility of the keying features may be better optimized, and there is a further need for ink sticks having keying features that can be compatible with parallel insertion and feed to facilitate vertical loading or alternative loaders with feed orientation that may range from horizontal to vertical whether or not insertion is in the feed direction.

SUMMARY

In one aspect, an ink loader for a phase change ink imaging device comprises at least one guide member for maintaining alignment and orientation of ink sticks as the ink sticks feed to a melt area of an ink loader. The ink loader also includes a keyed opening through which ink sticks are inserted into the ink loader. The keyed opening is positioned with respect to the at least one guide member such that color and model keying elements of ink sticks are spatially separated from the at least one guide member during and after insertion.

In accordance with another aspect, a feed system for a phase change ink imaging device comprises an ink loader having a feed area and a melt area. At least one guide member is in the ink loader for maintaining alignment and orientation of ink sticks relative to the ink loader as the ink sticks move from the feed area to the melt area of the ink loader. A keyed opening controls access into the feed area, the keyed opening is shaped to allow complementarily shaped ink sticks to be inserted into the feed area. The keyed opening may lie substantially in a plane approximately transverse to the at least one guide member. The keyed opening is oriented with respect to the at least one guide member such that color and model keying elements of ink sticks are spatially separated from the at least one guide member during and after insertion.

In accordance with yet another aspect, a method of feeding ink sticks in a phase change ink imaging device comprises inserting an ink stick through a keyed opening in an ink loader, the keyed opening may be oriented substantially transverse to the first direction. At least one guide element of the ink stick is engaged by at least one guide member in the ink loader after insertion. The ink stick is then moved to a melt area of the ink loader. Color and series keying elements of the ink stick are spaced from the at least one guide member of the feed channel as the ink stick is moved to the melt area.

DETAILED DESCRIPTION

Figure 1:
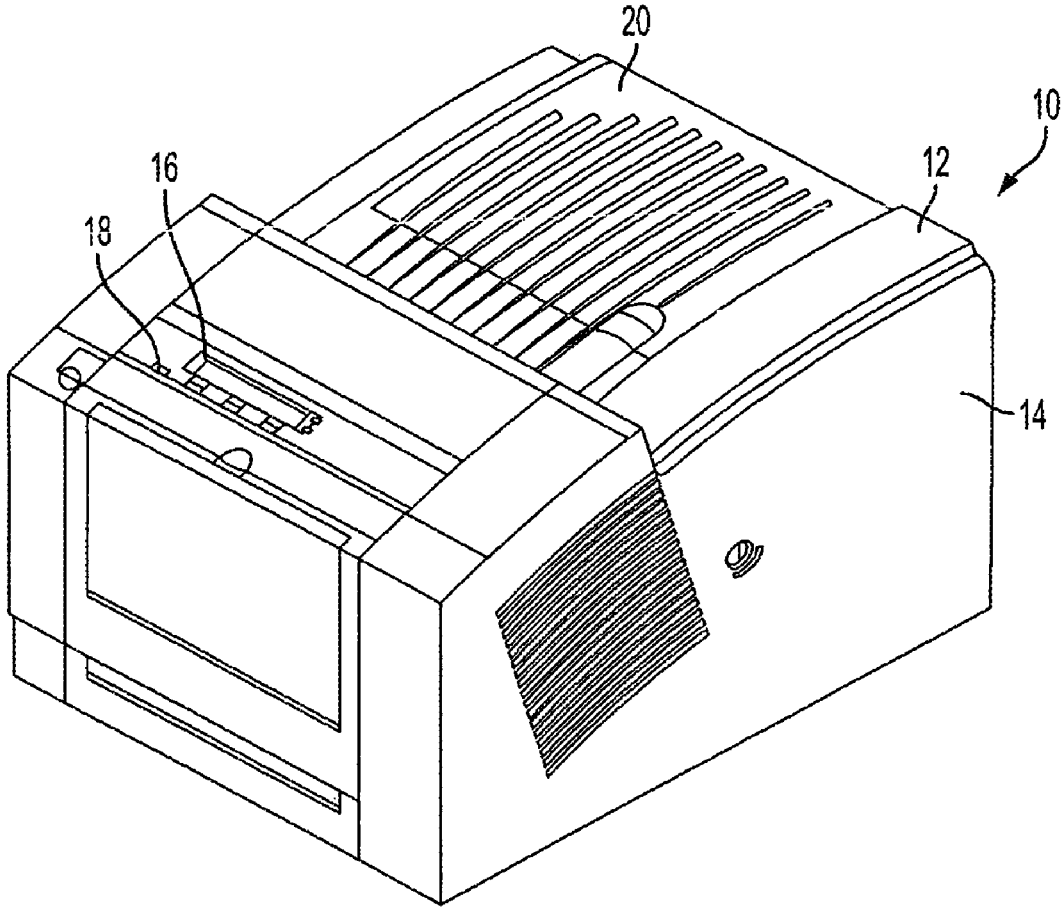
FIG. 1 is a perspective view of an exemplary phase change ink printer.

FIG. 1 is a perspective view of an exemplary phase change ink printer 10. Printer 10 includes an outer housing having a top surface 12 and side surfaces 14. A user interface display, such as a front panel display screen 16, displays information concerning the status of the printer, and user instructions. Buttons 18 or other control elements for controlling operation of the printer are adjacent the user interface window, or may be at other locations on the printer. An ink jet printing mechanism (not shown) is contained inside the housing. The printer includes an access cover 20 that opens (see FIG. 2) to provide the user access to an ink feed system (see FIG. 3) contained under the top surface of the printer housing that delivers ink to the printing mechanism.

Figure 2:
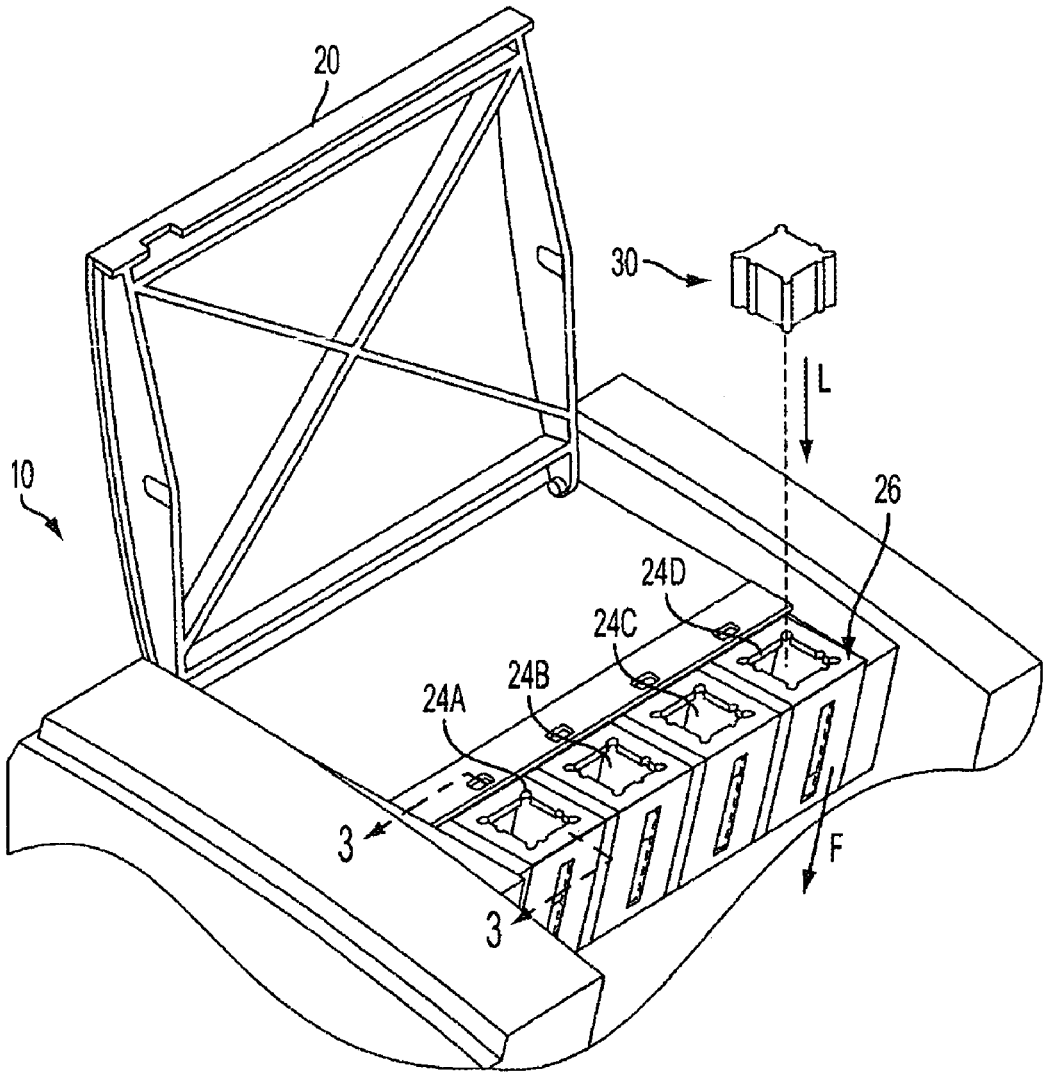
FIG. 2 is a partial top perspective view of the rear section of the phase change ink printer of FIG. 1 with its ink access cover open.

FIG. 2 is a partial top/front perspective view of the phase change ink printer 10 with its ink access cover 20 open. As seen in FIG. 2, opening the ink access cover 20 reveals a key plate 26 having keyed openings 24. Each keyed opening 24A, 24B, 24C, 24D provides access to an insertion end of one of several individual feed channels 28A, 28B, 28C, 28D of the solid ink feed system (see FIG. 3). A color printer typically uses four colors of ink (black, cyan, magenta, and yellow). Each color corresponds to one of the feed channels. In the illustrated embodiment, the key plate has four keyed openings 24A, 24B, 24C, and 24D. Each keyed opening 24A, 24B, 24C, 24D of the key plate 26 has a unique shape. The ink sticks 30 of the color for that feed channel have a shape corresponding to the shape of the keyed opening 24A, 24B, 24C, 24D. For example, the lateral sides of the key plate openings and the lateral sides of the ink sticks may have corresponding shapes. The keyed openings and corresponding ink stick shapes are designed to ensure that only ink sticks of the proper color are inserted into each ink stick feed channel.

Figure 3:
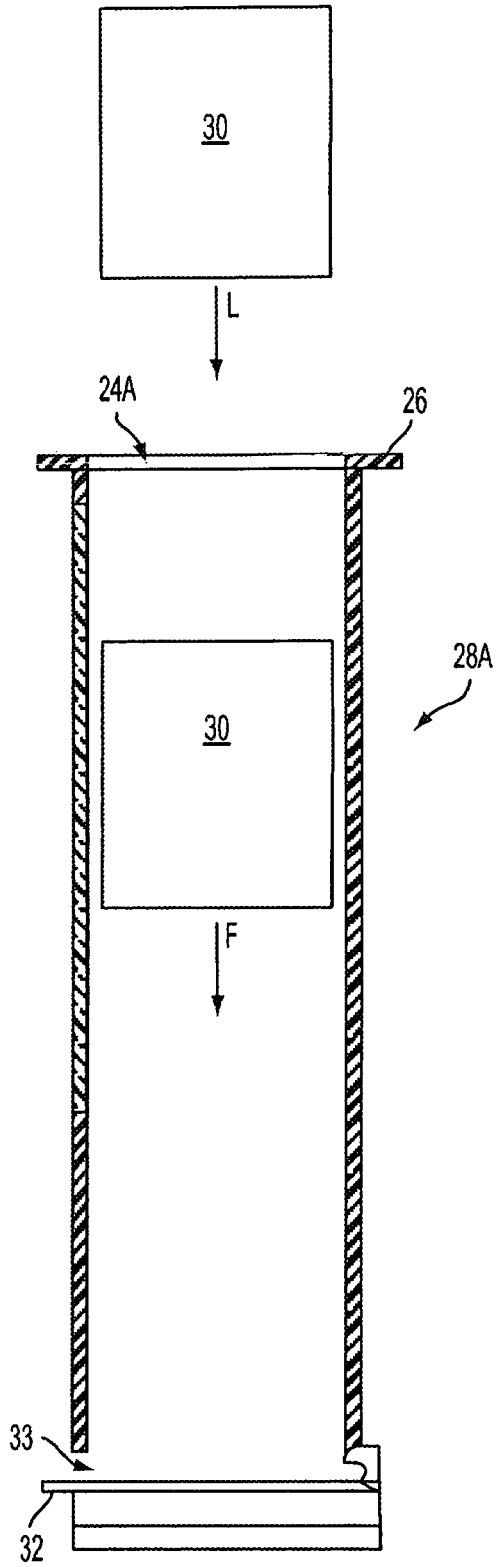
FIG. 3 is a side sectional view of a feed channel of the solid ink feed system of the phase change ink printer taken along lines 3-3 of FIG. 2.

Referring to FIG. 3, each feed channel, such as representative feed channel 28A is a vertically oriented feed channel designed to deliver ink sticks 30 of a particular color to a corresponding melt plate 32. The vertical orientation of the ink loader simplifies the ink loader by eliminating the need for complex mechanisms designed to urge an, ink slick along a horizontally oriented feed channel, where support friction inhibits movement. The vertical orientation may be any orientation that is sufficiently vertical so that gravity provides the primary motive force to feed the ink sticks along the feed channel and to hold the ink sticks against the melt plate 32 as they are melted.

Figure 4:
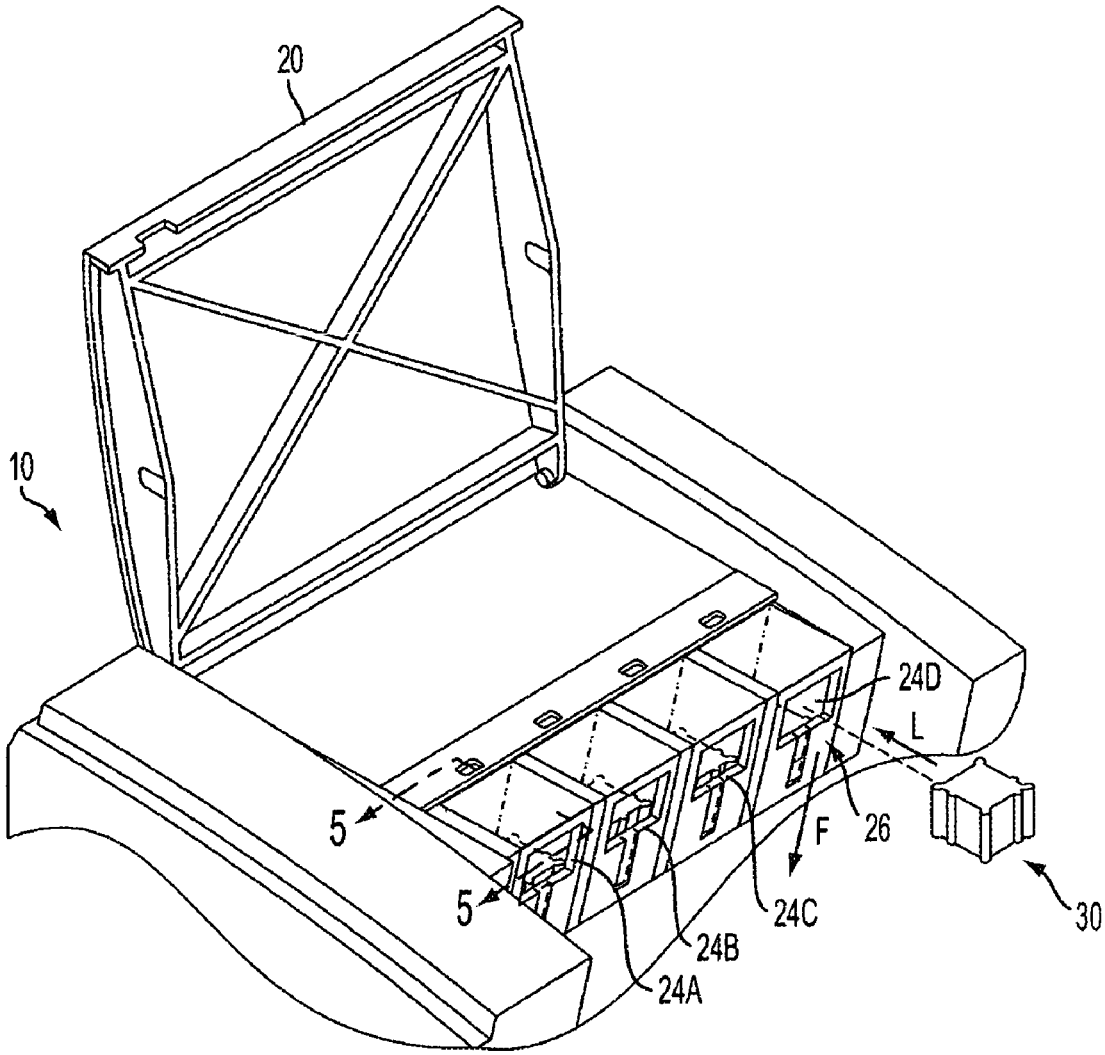
FIG. 4 is a perspective view of the phase change ink printer of FIG. 1 with its ink access cover open showing an alternate ink loader configuration.
Figure 5:
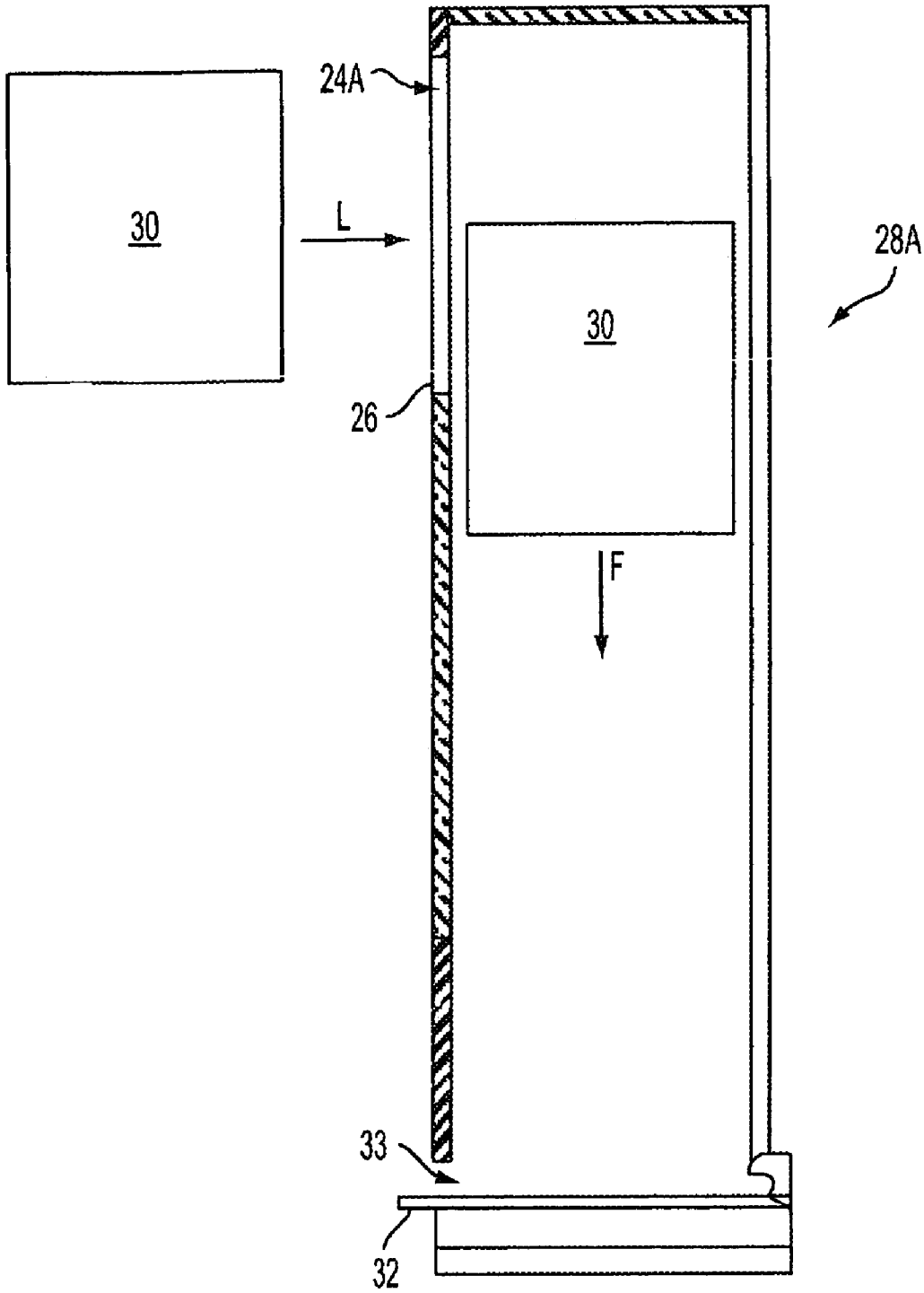
FIG. 5 is a side sectional view of a feed channel of the solid ink feed system of the phase change ink printer of FIG. 4.

The feed channel receives ink sticks inserted in an insertion direction L at the insertion end through keyed opening 24A. In the embodiment of FIGS. 2 and 3, the insertion and feed directions L, F are substantially parallel. Thus, the key plate 26 and keyed openings 24A-D are oriented substantially perpendicular to the insertion and feed directions to provide access to the feed channels such that ink sticks are inserted in the feed direction F of the feed channel. In an alternative embodiment as shown in FIGS. 4 and 5, the insertion direction L may be different from the feed direction F. For example, as in the embodiment of FIGS. 4 and 5, the key plate 26 and keyed openings 24A-D may be oriented substantially perpendicular to the insertion direction L and substantially parallel to the feed direction F of the feed channel such that ink sticks may be inserted in the insertion direction L and then moved along the feed channel in the feed direction F.

Referring now to FIGS. 3 and 5, the feed channel has sufficient longitudinal length that multiple ink sticks may be inserted into the feed channel. Each feed channel delivers ink sticks along the longitudinal length or feed direction F of the channel to the corresponding melt plate 32 at the melt end of the feed channel. The melt end of the feed channel is adjacent the melt plate 32. The melt plate 32 melts the solid ink stick into a liquid form. The melted ink typically drips or flows through a gap 33 between the melt end of the feed channel and the melt plate, and into a liquid ink reservoir (not shown).

Figure 6:
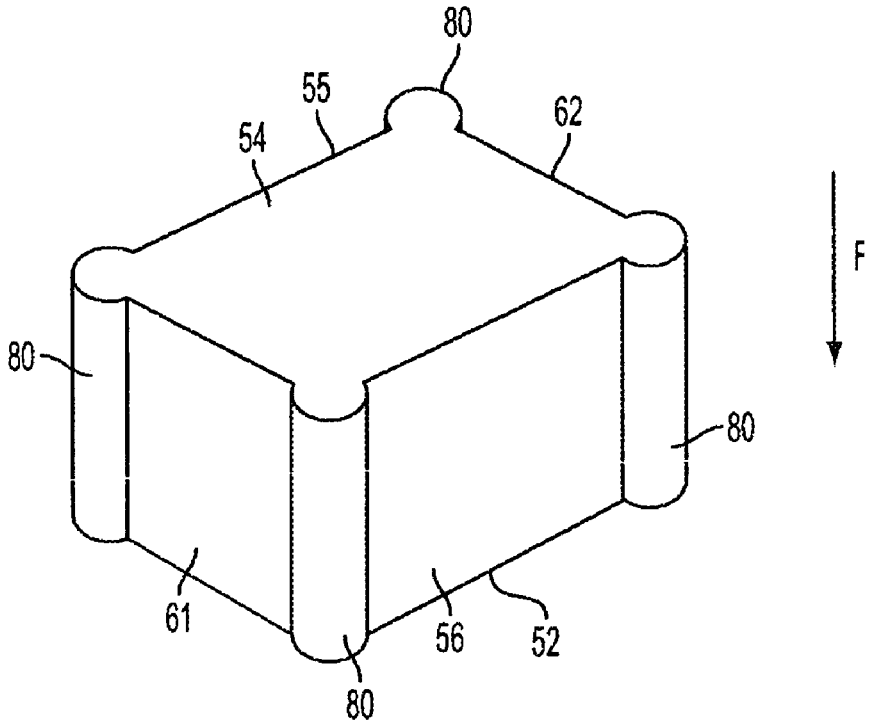
FIG. 6 is a perspective view of one embodiment of a solid ink stick.
Figure 7:
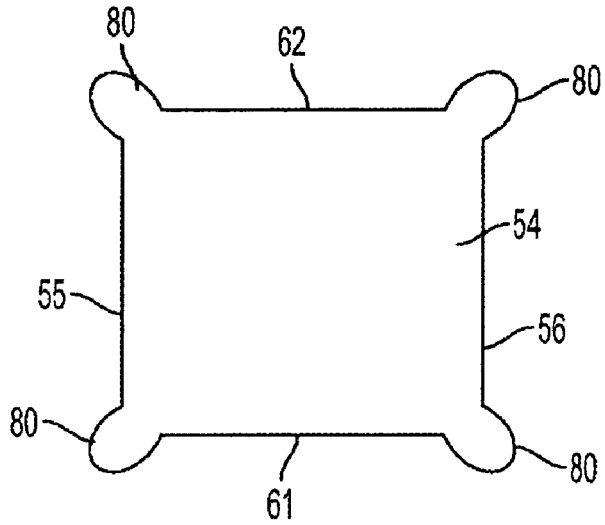
FIG. 7 is a top view of the solid ink stick of FIG. 6.

An exemplary solid ink stick 30 for use in the feed system is illustrated in FIGS. 6 and 7. The ink stick is formed of a three dimensional ink stick body. A substantially cubic ink stick body is illustrated in FIG. 6. The ink stick body illustrated has a bottom, represented by a general bottom surface 52, and a top, represented by a general top surface 54. The top and bottom surfaces are shown substantially parallel one another. The ink stick body also has a plurality of side extremities, such as side surfaces 55, 56, 61, 62. The side surfaces 55, 56 are substantially parallel one another, and are substantially perpendicular to the top and bottom surfaces 52, 54. The side surfaces 61, 62 are also substantially parallel one another, and substantially perpendicular to the top and bottom surfaces, and to the lateral side surfaces.

The respective surfaces of the ink stick body need not be substantially flat, nor need they be substantially parallel or perpendicular to one another. Other shapes of the side and end surfaces are also possible, including curved surfaces. The aspect ratios of the ink stick length to height to width could be substantially different. Some ink sticks may be quite long relative to their width, as example. The ink stick can be generally elongated lengthwise, widthwise or even in height or be altered in form in other ways. The lateral side surfaces can also be segmented or stepped, so that one portion of the ink stick body is narrower than another. Nevertheless, the present descriptions should aid the reader in visualizing, even though the surfaces may have three dimensional topographies, or be angled with respect to one another. The ink stick body may be formed by pour molding, injection molding, compression molding, or other known techniques.

The ink stick 30 includes side surfaces 55, 56, 61, 62 that are oriented substantially parallel to the feed direction F of the feed channel 28. The bottom surface 52 is a leading end surface which is intended to contact the melt plate of a feed channel first, and the top surface 54 is a trailing end surface. In one embodiment, the ink stick 30 includes corner guide elements 80 for interacting with guide members 104 (See FIG. 8) of a feed channel to maintain the orientation and alignment of the ink stick in the feed channel as gravity feeds the ink stick along the feed channel. This interaction of the corner guide elements 80 limit the movement of the ink stick 30 in the feed channel in directions that are perpendicular to the feed direction F. Limiting the relative movement of the ink sticks in directions other than the feed direction prevents rotational movement and skewing of the ink stick which may cause jams and/or improper alignment with the melt plate. Additionally, the use of guides at the extreme corners of an ink stick ensures that the larger surface/perimeter areas of the general sides of an ink stick have room to incorporate an extensible range of color and series keying features. Corner guide elements will be described as extending along the corner edge from the leading face to the trailing face of an ink stick and this description is intended to include non straight line topography and full or partial and segmented lengths of any length which can be intermediate or extending outward from the front and rear faces.

In one embodiment, the corner guide elements 80 comprise protrusions that extend at least partially along the corner edges of the ink stick parallel to the feed direction. In the embodiment of FIGS. 6 and 7, there is shown a corner guide element 80 at each corner, although corner guide elements 80 may be used at one, two or three corners. When using only two guide elements, they would ideally be positioned at opposite diagonal corners of the ink stick, though they could be on opposite sides so the term opposite corner is intended to encompass both relationships. Thus, contact between the ink stick 30 and feed channel 28 may be controlled and distributed more evenly thereby permitting low damping friction forces and reducing the effects of dimension intolerances between the feed channel and ink stick. Therefore, the ink stick body does not become skewed with respect to the feed channel. With the ink stick properly aligned with the feed channel, the ink stick meets the melt plate 32 with the intended attitude and alignment. Proper alignment between the ink stick and the melt plate enhances even melting of the ink stick. Even melting reduces the formation of unmelted slivers at the trailing end of each ink stick. Such unmelted slivers may slip through the gap 33 between the melt plate and the end of the feed channel. Such slivers may interfere with the proper functioning of certain portions of the printer or be introduced into different color reservoirs causing color mixing.

Figure 8:
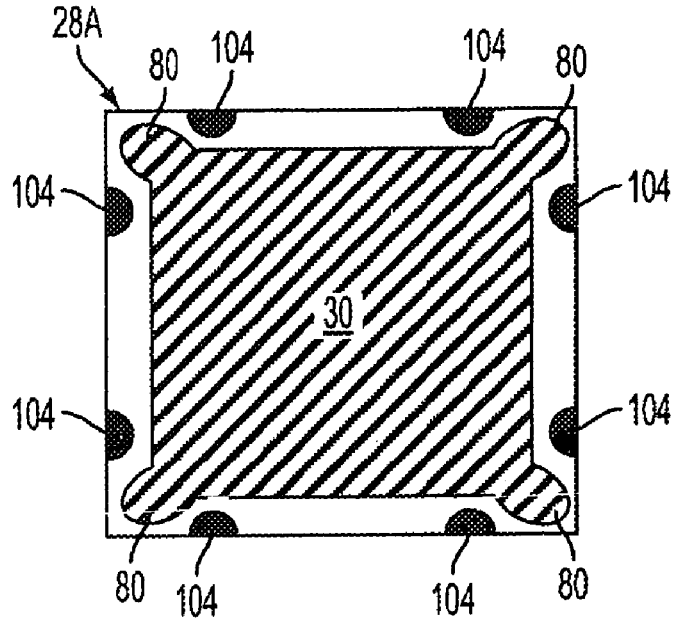
FIG. 8 is a sectional view of a feed channel showing corner guide members and the ink stick of FIG. 7 with complementary corner guide elements.

FIG. 8 shows a cross sectional view of the vertical feed channel 28 of FIGS. 3 and 5. As mentioned above, in a vertical or somewhat vertical loader, gravity may be relied upon to provide the force for moving the ink stick along the channel from the insertion end to the melt end. A gravity ink feed system may be augmented with a further nudging means, such as vibration, small abrupt motion, air blast or any other reasonable means to ensure feed reliability in view of variable exposure or environments (off angle product orientation, dropping the product during relocation, elevated temperatures, damaged ink sticks and the like). References to gravity feed therefore include the possibility of such augmentation but in these cases gravity is the primary motive force and under optimal conditions is all that is necessary to feed the ink. The feed channel includes guide members 104 for constraining movement to the feed direction by interacting with the guide elements 80 of an ink stick 30. In the embodiment of FIG. 8, the feed channel guide members comprise corner protrusions that extend the length of the feed channel substantially parallel to the feed direction F. A pair of guide members 104 is provided for each corner guide element 80 of the ink stick 30. Each pair of guide rails or members 104 for each corner guide element 80 define a space that is substantially complementary to the corner guide element 80. The complementary shape of the space formed by the corner guide members 104 of the feed channel allow the corner guide elements 80 of the ink stick body to slidingly engage the feed channel guide members 40 of the ink stick feed channel 28 to allow the passage of the ink stick 30 along the feed channel while limiting lateral and rotational movement of the ink stick. The corner guide members 104 of the feed channel may be formed integrally as part of the feed channel body. Many other ink loader guide shapes are contemplated, such as "V" rails, arced, contoured or segmented rails and so forth.

Figure 9:
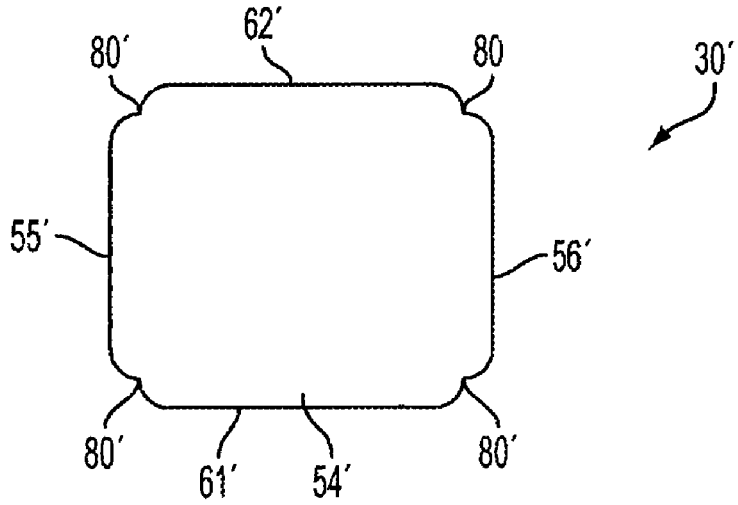
FIG. 9 is a top view of an alternate ink stick configuration with inset corner guide elements.

Although the corner guide elements 80 of an ink stick have been described as protrusions, other forms of corner guide elements are contemplated. For instance, as shown in FIG. 9, corner guide elements 80' may comprise an inset portion that extends along the corners of an ink stick 30'. The shape, placement and number of guide elements would be matched with complementary guide rails or members in the ink loader.

Figure 10:
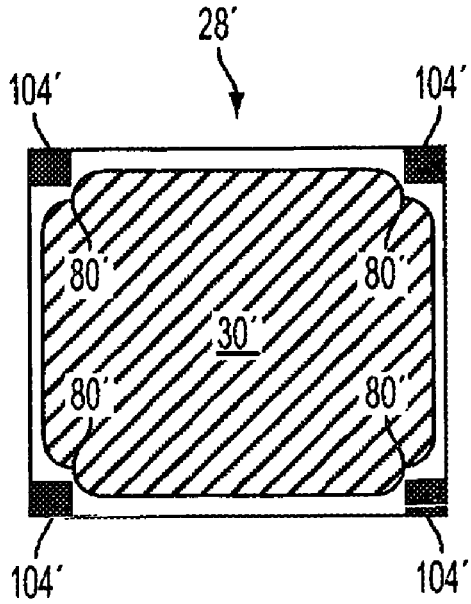
FIG. 10 is a sectional view of a feed channel showing alternative corner guide members and the ink stick of FIG. 9 with complementary corner guide elements.

FIG. 10 also shows an embodiment of a feed channel for guiding ink sticks having guide members 104' extending from the corners of the feed channel to slidingly engage the inset corner guides in order to maintain the alignment of the ink stick in the feed channel. Still other forms of ink stick corner guides are also envisioned, such as truncated or flattened surfaces that interface with complementary guide features in the loader. A single, predominantly corner positioned (may be asymmetrical) guide element with a shape that is conducive to adequately restraining excess off axis free play of the ink shape is contemplated, though it may not be optimal, it offers an alternative that may be a desirable option.

The corner guide elements 80 may be mutually independent from any keying features that may be incorporated in the ink stick. For example, the corner guide elements may be unchanging and present on ink sticks intended for printers across multiple platforms and models. The guide shapes used may be accommodated in all keyed openings of ink loaders for the different printers. The use of corner guide elements that are the same across the various platforms enables the feed system to be substantially the same on all units. Independent color and series keying (explained in more detail below) allows the modification or omission of the keying elements without affecting the basic loader configuration. A modification in the keying scheme of the ink sticks requires a change in the key plate configuration to accommodate the keying scheme and not a change to the parts internal to the ink loader, such as feed channel configuration. Due to size or fabrication limitations with some ink sticks, it may be desirable to have a side color or model keying feature extend fully or partially into a corner guide feature. In this case both features could exist and function independently but happen to be adjacent one another.

Figure 11:
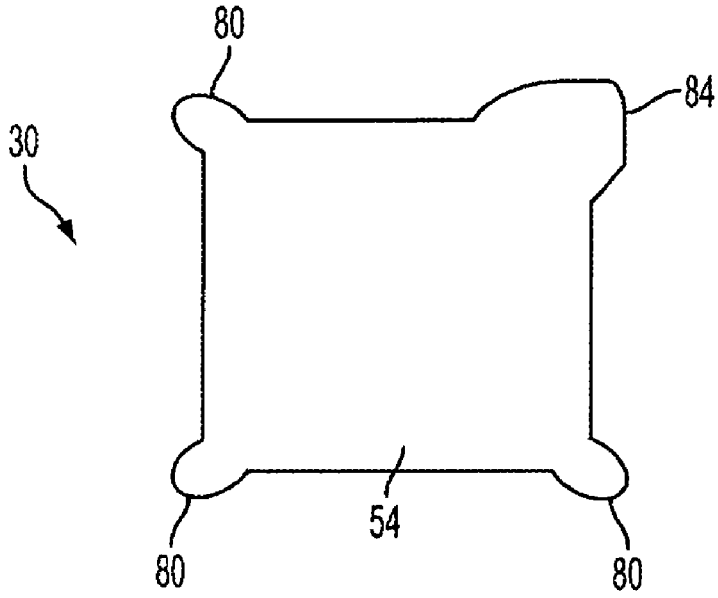
FIG. 11 is a top view of an embodiment of a solid ink stick with a corner guide having an orientation feature.

To prevent erroneous ink insertion when the corner guides and/or key element patterns (size and position) are symmetrical, the ink stick may include an orientation feature 84 as shown in FIG. 11. The orientation feature 84 illustrated comprises a modified corner guide element of the ink stick. A corner guide element may be modified in any suitable manner to facilitate proper insertion of the ink stick into the correct feed channel. For instance, in the embodiment of FIG. 11, the orientation feature 84 comprises a corner guide element having a greater width than the other corner guide elements 80. The key plate includes a complementary shaped portion that allows the insertion of the unique corner guide element so that the ink stick is oriented correctly prior to insertion. Thus, the orientation feature provides further mechanisms for prohibiting incorrect insertion of the ink stick 30 into a feed channel. Those skilled in the art will identify numerous other modifications and configurations of the corner guide elements to facilitate proper orientation of the ink stick for insertion. For example, the orientation feature can be provided by the relative positioning of the color and/or series key elements 70. Two corner guide elements on corners of opposite sides but not diagonally opposed can also be used to provide orientation and can be configured to do so with or without assistance from features used for keying. With respect to insertion keying, the ink loader or feed system keyed opening may be in a plate or may be incorporated into other elements of the ink loader, such as the channel or chute walls or one or more inserts that separately or in conjunction with the channel or other structure, make up a keyed opening. It is to be understood that a separate plate is not necessary and may not be present. Ink may be inserted into a loader body or receiving area transverse to the feed direction but the actual channel insertion keying may occur after the ink placement as the ink enters the feed channel. Orientation keying, such as truncating one side of one end, can be employed to prevent insertion of the ink into the receiving area unless it is in an orientation complementary to passage of the ink stick through the insertion keying en route to the feed channel. If a nominally incorrect ink stick were placed in this fashion, it would not proceed through the keyed opening and so could be retrieved so a correct stick could be inserted. Additional feed keying may be employed at any point in the feed channel beyond this feed direction insertion keyed opening. Feed key effectiveness in blocking inappropriate ink sticks is a nominal function, that is, undersize sticks may fit through.

The ink stick may include keying elements 88 for interacting with the keyed openings 24A, 24B, 24C, 24D of the key plate 26 to ensure that only ink sticks intended for a specific feed channel are inserted into the feed channel. The key elements 88 comprise a feature of a particular predetermined size, shape, and location on the outer perimeter of the ink stick body that extend at least partially the length of a side surface generally parallel to the insertion direction L of an ink loader. In the particular example illustrated in which the insertion direction L and feed direction F are substantially parallel, the ink stick key element 88 comprises a protrusion or ridge that extends from the top to bottom surface of the ink stick substantially parallel to the feed direction F of the ink loader. Key elements, however, may comprise inset features as well, such as, for example, recesses and notches. The key element 88 is shaped and positioned to match a complimentary key 90 formed in the perimeter of the keyed opening 24 in the key plate.

Each color for a printer may have a unique arrangement of one or more key elements in the outer perimeter of the ink stick to form a unique cross-sectional shape for that particular color ink stick. The combination of the keyed openings 24 in the key plate 26 and the keyed shapes of the ink sticks 30 (formed by the key elements 70) insure that only ink sticks of the proper color are inserted into each feed channel. A set of ink sticks is formed of an ink stick of each color, with a unique key arrangement for ink sticks of each color. In one embodiment, key elements 88 for differentiating between colors of an ink stick may be placed on a single side of each ink stick of a multi-color set of ink sticks. The positioning of the key elements along a perimeter segment of an ink stick may progressively correspond to the progressive position of the keyed opening (and associated feed channel) relative to the other keyed openings in the ink loader mechanism.

Figure 12:
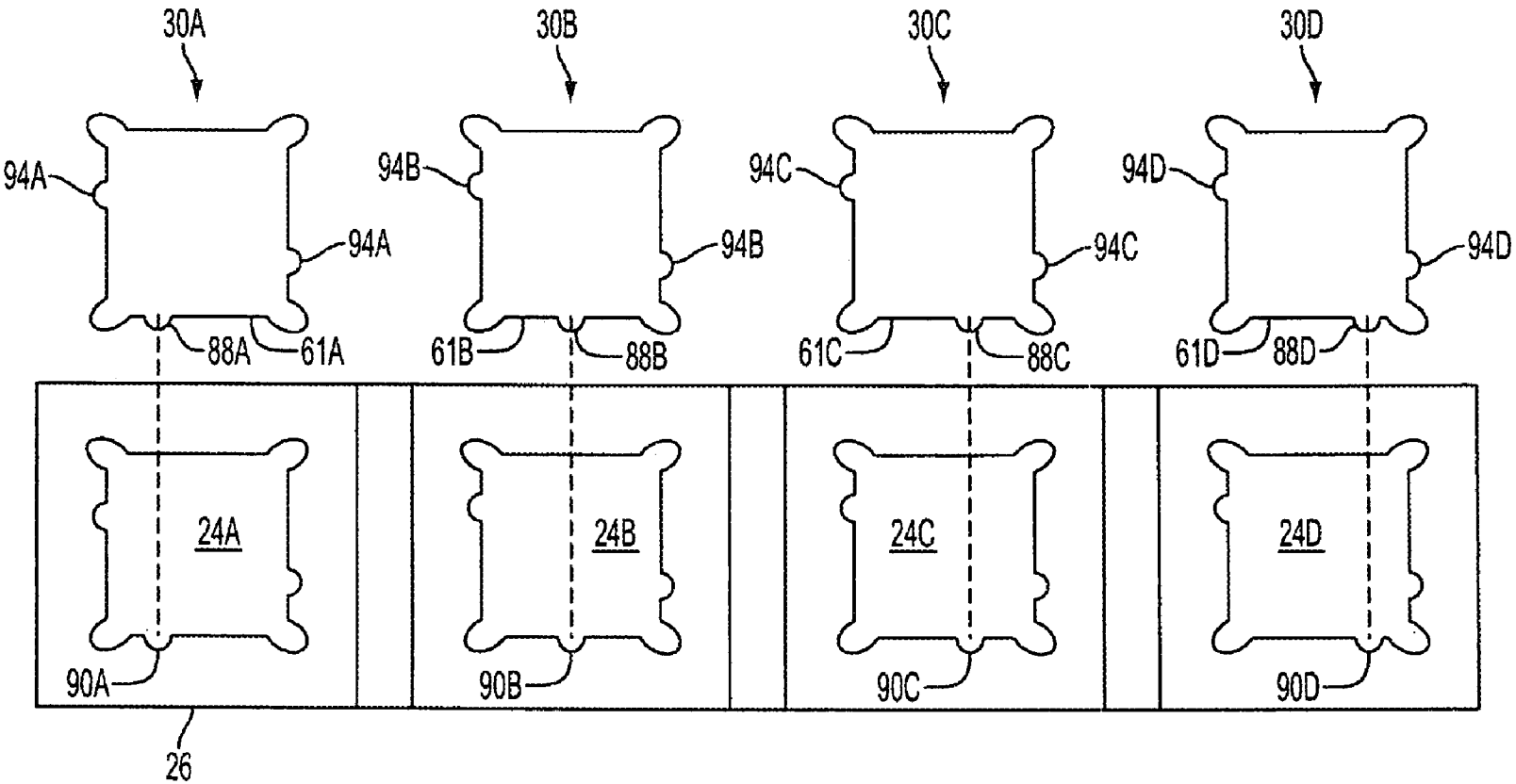
FIG. 12 is diagrammatical illustration of a multi-color set of ink sticks with progressive color key element, series keying and corresponding key plate.
Figure 13:
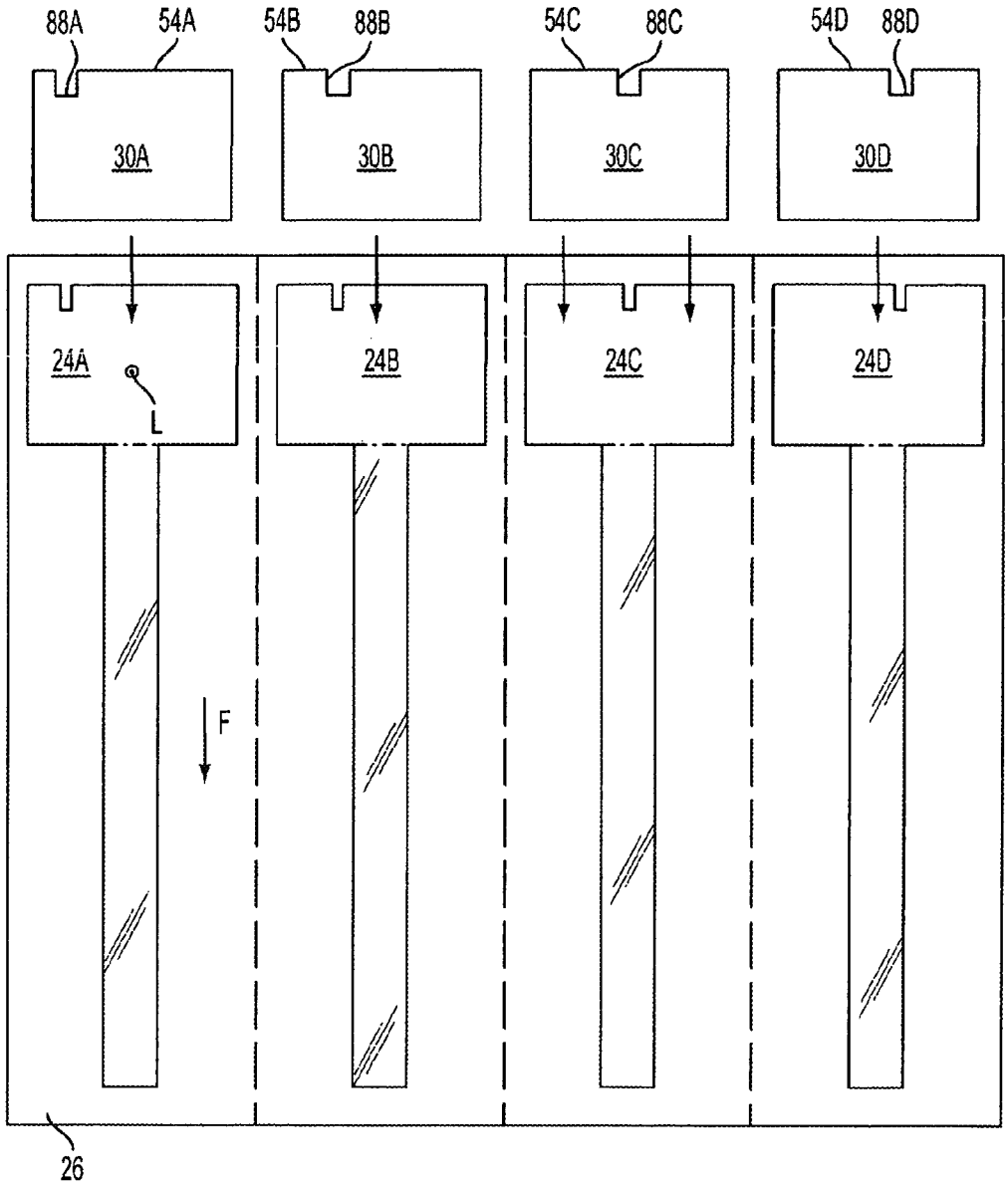
FIG. 13 is diagrammatical illustration of an embodiment of parallel progressive color keying.

Referring to FIG. 12, there is shown an embodiment of the progressive keying scheme implemented in a set of ink sticks intended for the ink loader of FIGS. 2 and 3 in which the insertion direction L and feed directions are substantially parallel. In this embodiment, the progressive orientation of the key elements 88A-D is parallel to the orientation of the feed channels. Thus, the ink stick 30A intended for the first feed channel 28A includes a key element 88A that is positioned the farthest to the left with respect to the other key elements 88B-D of the ink sticks 30B-D. The ink stick 30B intended for the second feed channel 28B includes a key element 88B that is positioned the second farthest to the left, etc. FIG. 13 shows an embodiment of the progressive keying scheme for the ink loader of FIGS. 4 and 5. In this embodiment, the insertion direction L is different than the feed direction F. The key elements comprise inset grooves that extend along the top surface 54 substantially parallel to the insertion direction L. Similar to the embodiment of FIG. 12, the ink stick 30A intended for the first feed channel 28A includes a key element 88A that is positioned the farthest to the left with respect to the other key elements 88B-D of the ink sticks 30B-D. The ink stick 30B intended for the second feed channel 28B includes a key element 88B that is positioned the second farthest to the left, etc.

Figure 14:
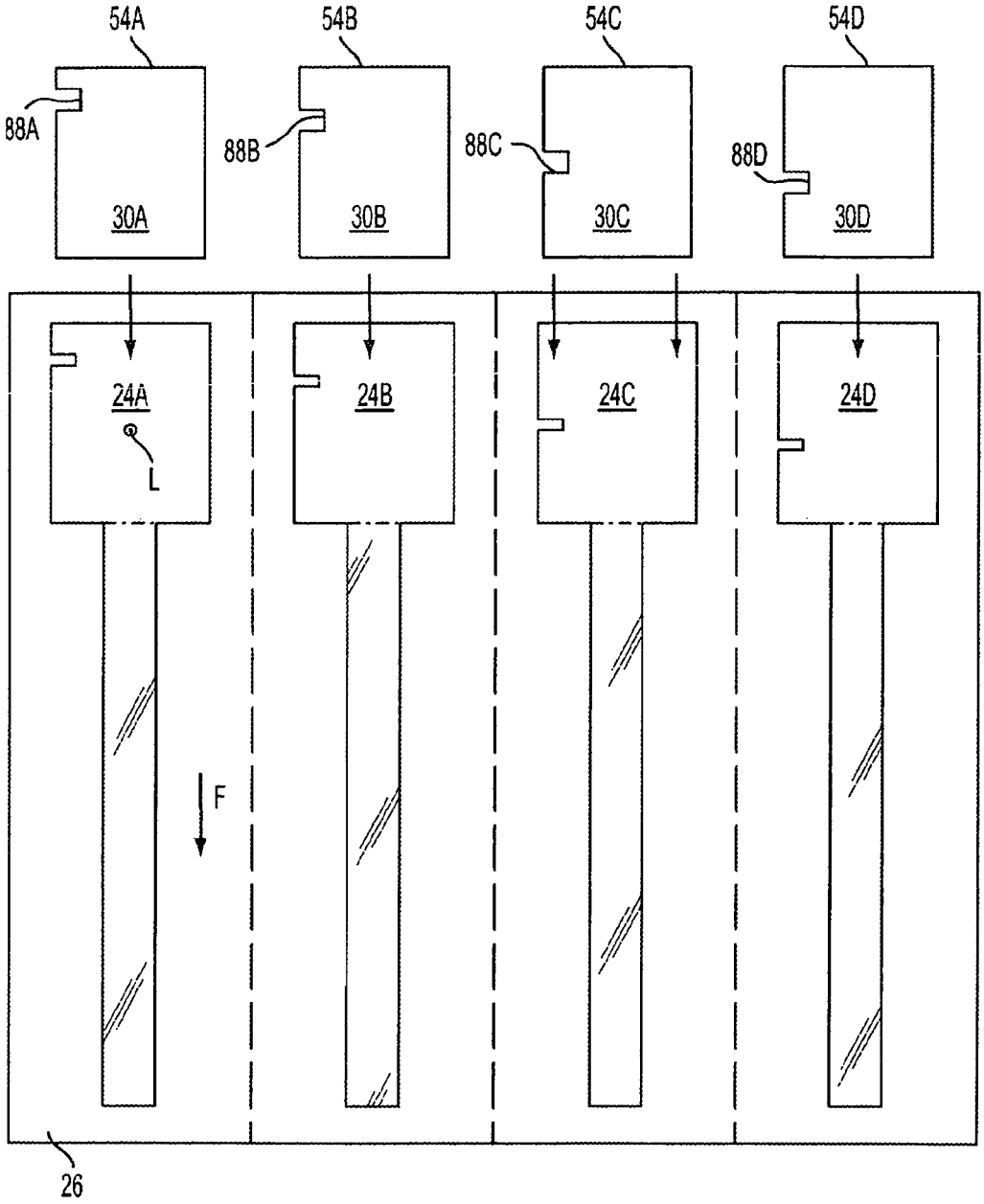
FIG. 14 is diagrammatical illustration of an embodiment of perpendicular progressive color keying.

Although the key elements 88A-D are shown as being on a perimeter segment that is substantially parallel to the orientation of the feed channels, the progressive keying scheme of FIG. 10 may be implemented on any side of the ink stick that is substantially aligned with insertion direction L. For example, FIG. 14 shows an embodiment of the progressive keying scheme in which the keying elements have a perpendicular progressive orientation. In the perpendicular progressive orientation, the keying elements may be sequentially positioned along a perimeter segment or surface that is oriented substantially perpendicularly to the left to right orientation of the feed channels. For instance, as shown in FIG. 14, the keying elements are sequentially positioned along a side surface with each sequential position of the keying elements 88 corresponding to the sequential left to right positioning of the feed channels. The perpendicular progressive orientation may be useful in situations in which the perimeter segments of an ink stick that are parallel to the orientation of the feed channels are narrow, thereby precluding a practical implementation of the progressive keying scheme shown in FIGS. 12 and 13.

The single side placement of the keying elements 88 as well as sequential positioning of the key elements has the added benefit of promoting user familiarity with the keying scheme to further ensure that an ink stick is loaded in the proper feed channel. For instance, a printer operator can associate an ink stick with a particular feed channel of the printer by correlating the position of the key element with the correspondingly positioned keyed opening in the key plate.

In a manner similar to the color keying scheme, one or more series key elements 94 may be incorporated to provide series differentiation in order to ensure that only ink sticks intended for a particular printer are able to be inserted in the printer as shown in FIG. 12. Thus, a set of ink sticks intended for a particular printer may have one or more key elements 94 formed in the same position on each ink stick of the set as shown in FIG. 12. A set of ink sticks intended for a different printer may have one or more key elements formed in a particular position on each ink stick of the set that is the same position for each ink stick of the set but at a different position than ink sticks intended for other printers. In embodiments incorporating common side color keying, ink sticks may have up to three sides for incorporating series keying elements, thus, allowing for a wide range of differentiation between printer platforms and models. Additionally, the color key elements 88 and the series key elements 94 may be mutually independent in that the color key elements may be changed or omitted without affecting the configuration or operation of the series key elements and the series key elements may be changed or omitted without affecting the configuration or operation of the color key elements. Thus, ink sticks that are the same color but intended for different printers may have the same color key configuration but different series key configurations. Conversely, ink sticks that are intended for the same printer but are different colors may have the same series key configuration but different color key configurations.

In another embodiment, the series keying scheme may include "one way" or compatibility keying features in order to accommodate progressive product differentiation. For example, world markets with various marketing approaches, pricing, color table preferences, etc. have created a situation where multiple ink types or formulations may exist in the market simultaneously. Thus, ink sticks may appear to be substantially the same but, in fact, may be intended for different phase change printing systems due to factors such as, for example, date or location of manufacture; geographic variation including chemical or color composition based on regulations or traditions or special market requirements, such as "sold" ink vs. contractual ink supply, North American pricing vs. low cost markets, European color die loading vs. Asian color die loading, etc. A series keying scheme including compatibility keying may be implemented to ensure that ink stick configurations that are intended to be used with one or more phase change ink platforms, based on marketing approaches, ink formulations, geographic regulations, etc., are used only with those platforms. As an example, an ink formulation for one printer series may be compatible with a second printer series, but ink formulated specifically for the second printer series may not be compatible with the first printer series. Similarly, ink sticks intended for North American markets may be compatible with all printing platforms while ink sticks intended for low cost markets may not be compatible with North American printing platforms. This flexibility in one way keying accommodation allows for the intended multiple product use of some ink while appropriately preventing unintended alternate model use, such as convenience of accepting higher market price ink in a later model while preventing the lower market price ink of the later model from fitting into an earlier model. One way or compatibility keying configurations are defined by same color ink stick shapes that are very similar but differ to the extent that corresponding key plate insertion openings can be somewhat different so that alternate but similar shapes may be admitted or selectively excluded based on the size or configuration difference providing the compatibility keying. Though one way keying is facilitated by opportunities with corner guide ink stick configurations and single side color keying, the concept is intended to be extensible to any ink stick form and any ink loader configuration or orientation relative to gravity. One way or compatibility keying is not used for admitting or excluding different colors but rather same color sticks that would be used in different models or model variations.

Figure 15:
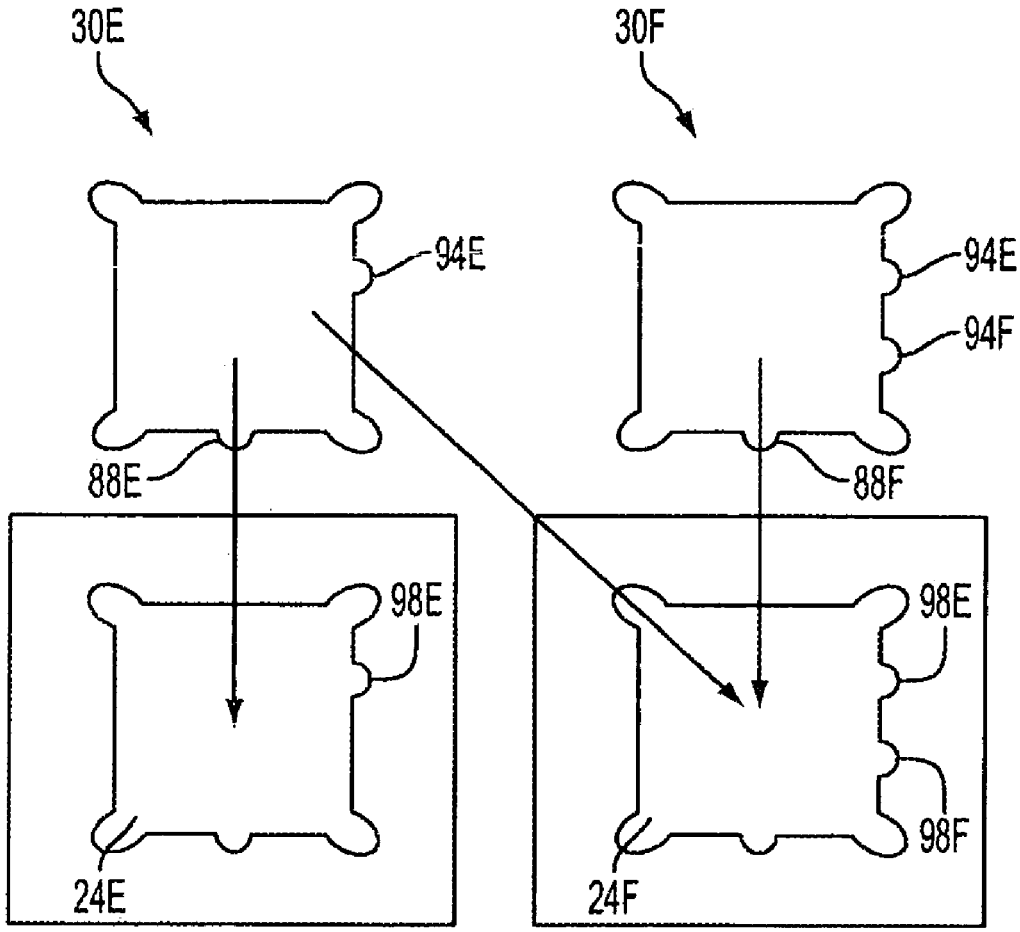
FIG. 15 is a diagrammatical illustration of an embodiment of one way series compatibility keying for two platforms.

Compatibility keying may be incorporated by varying a characteristic of the series key and accommodating the variation of the series key in the keyed openings of respective key plates. Ink stick shapes, including guide features and key elements, may otherwise be identical except for this variation in the series key. Take, for example, the case of two platform differentiation in which ink sticks for a first platform may be used with a second platform, but ink sticks for the second platform may not be used with the first platform. As shown in FIG. 15, a first series key feature 94E may be included on both types of ink sticks 30E, 30F that is of the same size, shape and location. A second series key 94F is included on ink stick 30F that is not included on ink stick 30E. Referring to the corresponding keyed openings 24E, 24F, the series key 94F has been accommodated in key plate 24F by incorporating a complementary keyed shape 94F in opening 24F such that both ink sticks 30E and 30F may be inserted through the keyed opening 24F. Conversely, ink stick 30F may not be inserted through the keyed opening 24E because it does not include a complementary shape 98F for accommodating the second key feature 94F of ink stick 30F. In the embodiment of FIG. 15 and other example figures, the key features comprise protrusions although any suitable feature may be utilized including inset features.

Figure 16:
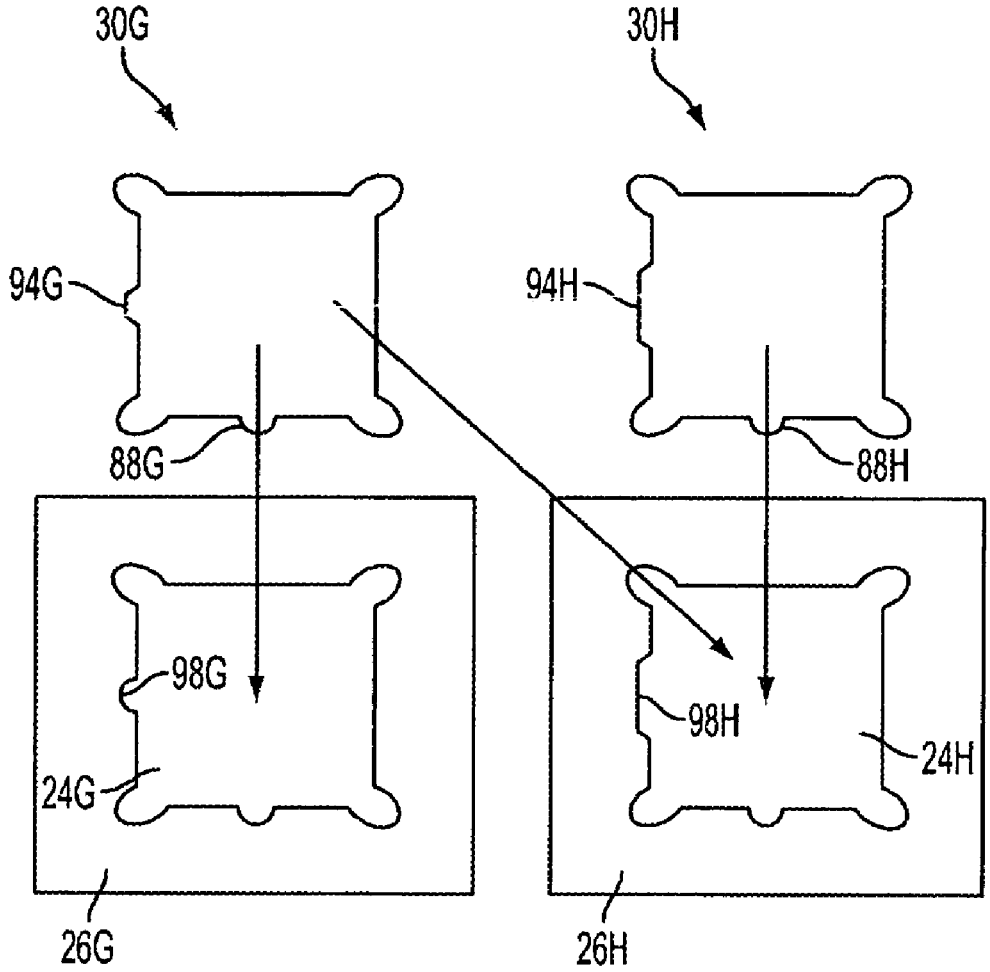
FIG. 16 is another diagrammatical illustration of an embodiment of one way series compatibility keying for two platforms.

In another embodiment, compatibility keying may be incorporated by varying a geometric characteristic of a series key element such as, for example, in the case of a protruding element, a width of the element. The more restricted ink sticks may have a wider or larger key feature, and less restricted ink sticks may have a smaller similarly shaped feature or one that would be enveloped by the larger in the same location. The passage of ink sticks through a keyed opening of the key plate may be controlled by varying the size of a complementary shape in the keyed opening of the key plate. For example, as shown in FIG. 16, ink sticks 30G and 30H include a key feature 94 in the same location on each ink stick. The key feature 94H on ink stick 30H is wider than the key feature 94G on ink stick 30G. Referring now to the corresponding key plates 26 of FIG. 16, key plate 26G includes a keyed opening 24G including a narrow shape 98G that is configured to allow the passage of ink stick 30G but not ink stick 30H. Key plate 26H includes a keyed opening 24H including a wide shape 98H that is configured to allow the passage of both ink sticks 30G and 30H. The configuration of an ink stick keying feature and the corresponding key feature in a key plate may have a dimension that is greater than these elements in a second configuration such that the first and second configuration ink stick fits through the key plate opening of the first configuration but only the second ink stick configuration fits through the key plate opening of the second configuration. Since the key feature can be an inset or a protrusion, the reference to a greater dimension defines one element of the ink stick dimension influencing the key feature so that when that dimension is greater, accomplishes the one way exclusion. As example, the greater dimension could apply to the width of the key feature itself in a protruding key configuration or an area adjacent to the key feature in an inset key configuration, the latter resulting in a narrower inset key width.

Figure 18:
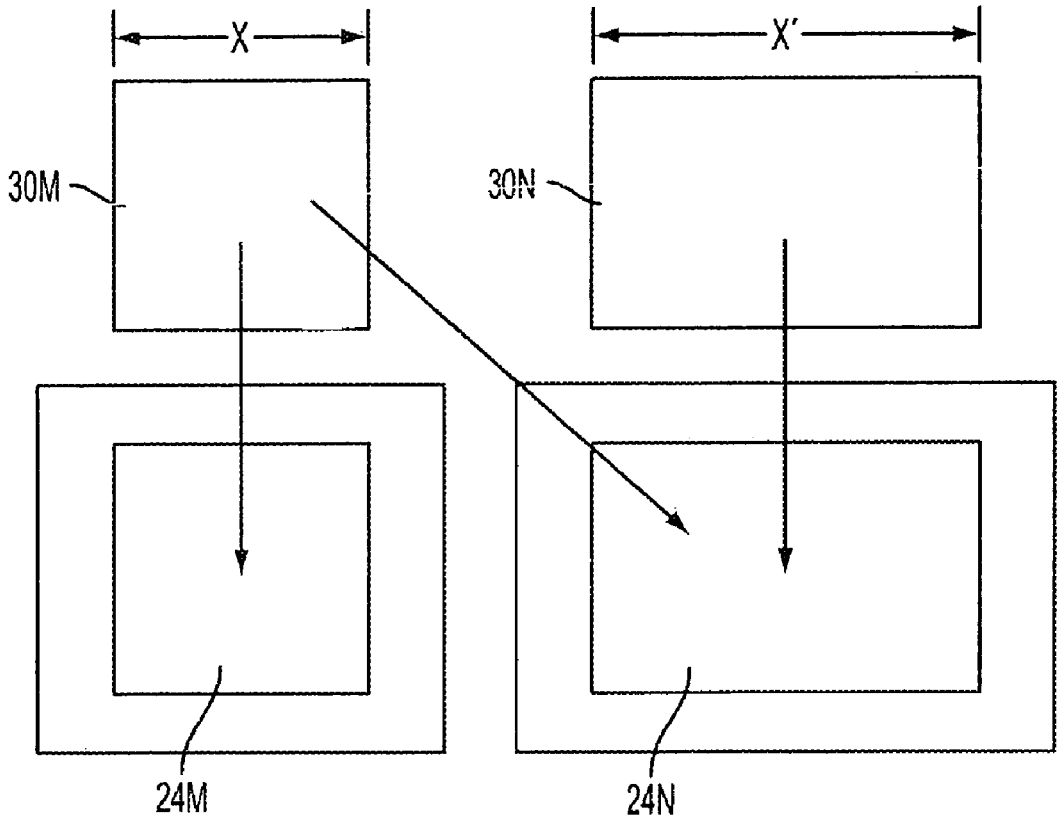
FIG. 18 is a diagrammatical illustration of yet another embodiment of one way series compatibility keying for two platforms.

Compatibility keying may be incorporated by varying the number of key features and/or varying a geometric characteristic of the key features or varying one or more dimensions of the ink stick or any combination. In addition, in embodiments in which color keying is incorporated on a single side of the ink stick, up to three sides may be used to incorporate compatibility keying. By varying the number and/or characteristics of key features compatibility keying may be extended beyond two platform differentiation. Therefore, many combinations of one way compatibility keying are possible across a wide range of acceptance and exclusion sets. Other dimensional variations can be employed to accomplish one way keying, as example, the length dimension of an ink stick perpendicular to insertion where two sticks might be identical except for a small but exclusionary increase in the length of stick two relative to stick one. As shown in FIG. 18, for instance, the ink stick 30M and ink stick 30N are substantially similarly shaped except the dimension X of ink stick 30M is smaller than the dimension X' of ink stick 30N. Thus, ink stick 30M may be inserted through the keyed openings 24M and 24N. Ink stick 30N may be inserted through keyed opening 24N, but, due to the larger dimension X', ink stick 30 is excluded from insertion through opening 24M.

Figure 17:
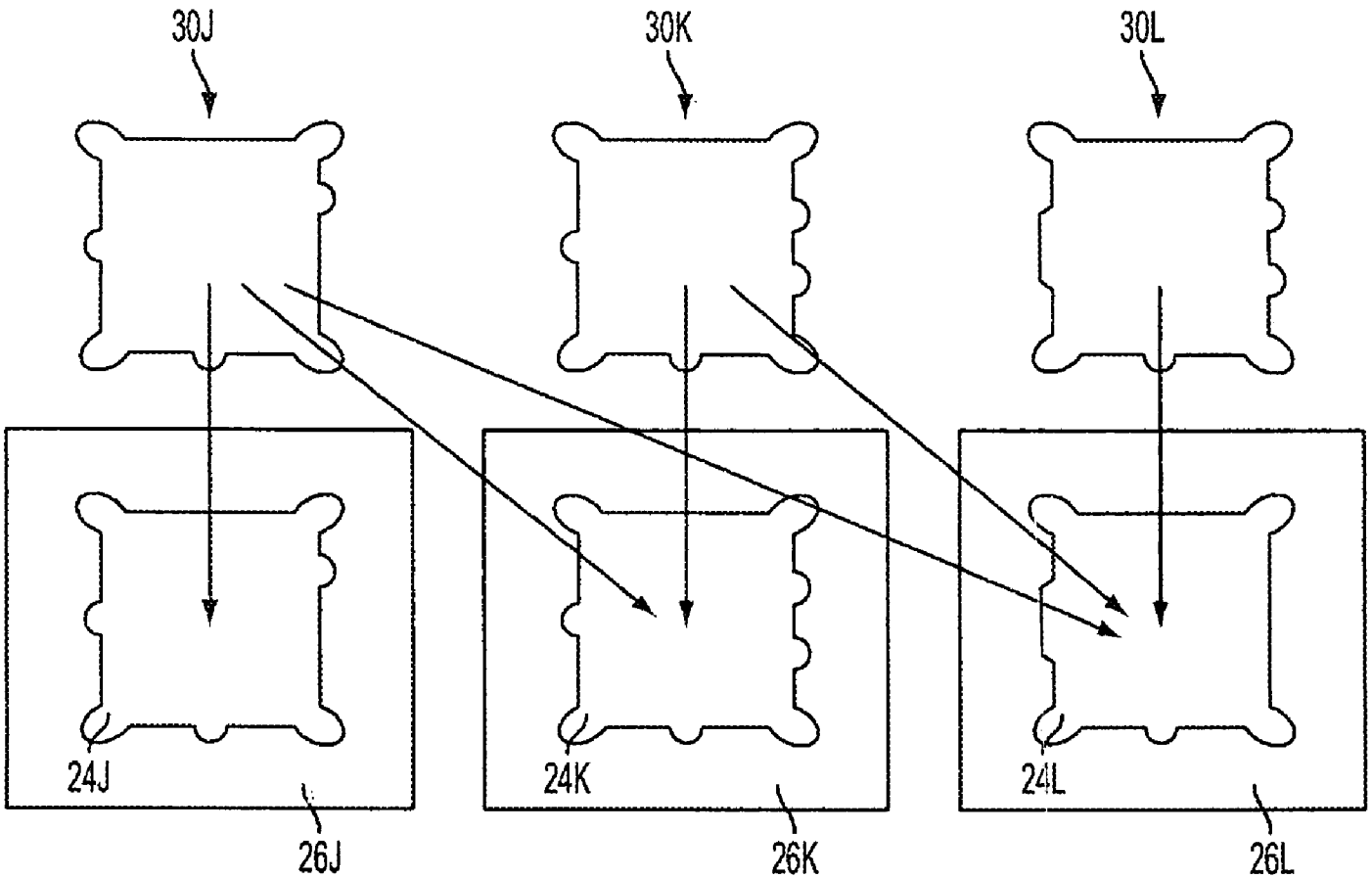
FIG. 17 is a diagrammatical illustration of yet another embodiment of one way series compatibility keying for three platforms.

FIG. 17 is a diagrammatical illustration of an embodiment of a compatibility keying scheme for three platform differentiating incorporating geometric and number variations in the series compatibility keying. As can be seen, ink sticks 30J, 30K and 30L may be inserted into key plate 26L. Ink sticks 30J and 30K may be inserted into key plate 26K, and only ink stick 30J may be inserted into key plate 26J. It can be appreciated that by varying the number, placement, shape of key features formed on up to three sides of an ink stick, the possible combinations of compatibility keying configurations is extensive.

The exemplary embodiments of the series and compatibility keying schemes depicted in FIGS. 15 and 17 are shown as incorporated into embodiments of ink sticks intended for the ink loader of FIGS. 2 and 3 in which the insertion direction L and feed directions F are substantially parallel. Thus, the keying features are shown as extending longitudinally along a surface of the ink stick in a direction parallel to the insertion and feed directions. These schemes, however, may be implemented in a similar manner for the ink loader of FIGS. 4 and 5 in which the insertion directions and feed directions are different as long as the keying features extend along a surface of the ink stick in a direction that is generally the same as the insertion direction of the ink loader.

Those skilled in the art will recognize that numerous modifications can be made to the specific implementations described above. It should be appreciated that the various male-female implementations of the various key features may be suitably reversed. Additionally, those skilled in the art will recognize that the guide elements located at the ink stick corners, intermediate the corners or in the bottom surface of the ink stick body, and guide rails or members in complementary locations may have numerous shapes other than the particular shapes illustrated. In addition, numerous other configurations of the feed channel, key plate, and other components of the ink feed system can be constructed. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An ink loader for a phase change ink imaging device comprising:

at least one guide member for maintaining alignment and orientation of ink sticks as the ink sticks are moved to a melt area of an ink loader; and a keyed opening having a key feature for interacting with a keying element of an ink stick to restrict insertion of ink sticks through the keyed opening to ink sticks having a keying element that is complementarily shaped and positioned to the key feature of the keyed opening, the keyed opening lying in a plane substantially transverse to the at least one guide member, the keyed opening having a guide element passage that is positioned with respect to the at least one guide member in the ink loader to align a guide element of an ink stick inserted though the keyed opening with the at least one guide member of the ink loader, the guide element passage being spatially separated from the key feature of the keyed opening.

2. The ink loader of claim 1, the at least one guide member extending at least partially from an area of the ink loader adjacent the keyed opening to the melt area.

3. The ink loader of claim 1, the at least one guide member being oriented within an angle range of horizontal to vertical relative to gravity.

4. The ink loader of claim 3, wherein gravity provides a primary force for moving ink sticks to the melt area of the ink loader.

5. The ink loader of claim 3, the at least one guide member comprising:

a pair of guide members positioned to engage a pair of guide elements that are on opposite sides of the ink stick; and another guide element passage in the keyed opening that corresponds to the other guide member in the pair of guide members.

6. The ink loader of claim 1, the at least one guide member being a corner guide member and the guide element passage being positioned at a corner of the keyed opening.

7. A feed system for a phase change ink imaging device comprising:

an ink loader having a feed area and a melt area;

at least one guide member in the ink loader for maintaining alignment and orientation of ink sticks relative to the ink loader as the ink sticks move from the feed area to the melt area of the ink loader;

a keyed opening having key features for interacting with keying elements of the ink sticks to restrict insertion of ink sticks through the keyed opening to ink sticks having keying elements that are complementarily shaped to the key features of the keyed opening, the keyed opening lying substantially in a plane approximately transverse to the at least one guide member, the keyed opening having a guide element passage that is oriented with respect to the at least one guide member to align a guide element of an ink stick with the at least one guide member as the ink stick is inserted through the keyed opening, the guide element passage being spatially separated from the keyed features of the keyed opening.

8. The feed system of claim 7, the at least one guide member extending substantially from the insertion area to the melt area.

9. The feed system of claim 7, the at least one guide member being oriented within an angle range of horizontal to vertical relative to gravity.

10. The feed system of claim 9, wherein gravity provides a primary force for moving ink sticks to the melt area of the ink loader.

11. The feed system of claim 9, the at least one guide member comprising:

a pair of guide members positioned to engage a pair of guide elements that are on opposite sides of the ink stick; and another guide element passage in the keyed opening that corresponds to the other guide member in the pair of guide members.

12. A method of feeding ink sticks in a phase change ink imaging device, the method comprising:

inserting an ink stick through a keyed opening in a first direction into an ink loader, the keyed opening being oriented substantially transverse to the first direction and having key features for interacting with keying elements of ink sticks to restrict insertion of ink sticks through the keyed opening to ink sticks having keying elements that are complementarily shaped to the key features of the keyed opening and positioned on the ink sticks to correspond to the position of the key features in the keyed opening;

aligning a guide element of an ink stick being inserted through the keyed opening with a guide element passage in the keyed opening to enable the guide element to engage the at least one guide member in the ink loader after the ink stick has passed through the keyed opening, the guide element passage of the keyed opening being spatially separated from the key features of the keyed opening; and moving the ink stick to a melt area of the ink loader in the first direction while the guide element of the ink stick remains engaged with the at least one guide member.

13. The method of claim 12, further comprising:

orienting the ink loader within an angle range of horizontal to vertical relative to gravity.

14. The method of claim 13, the moving of the ink stick to a melt area further comprising:

using gravity to move the ink stick to the melt area.

15. The method of claim 13, the alignment of the guide element further comprising:

aligning a pair of guide elements of the ink stick that are positioned on opposite sides of the ink stick relative to a longitudinal axis of the ink stick with a pair of guide element passages in the keyed opening to enable the pair of guide elements to engage a pair of guide members in the ink loader.

* * * * *